United States Patent [19]

Boyer

[11] Patent Number: 5,055,057

[45] Date of Patent: Oct. 8, 1991

[54] ELECTRIC PLUG LOCK

[76] Inventor: Paul L. Boyer, 226 Southerly Hills Dr., Englewood, Ohio 45322

[21] Appl. No.: 593,608

[22] Filed: Oct. 9, 1990

Related U.S. Application Data

[63] Continuation of Ser. No. 390,046, Aug. 7, 1989, abandoned.

[51] Int. Cl.[5] ..... H01R 13/422

[52] U.S. Cl. ..... 439/134; 439/133; 439/149; 439/304

[58] Field of Search ..... 439/133, 134, 149, 304

[56] References Cited

U.S. PATENT DOCUMENTS

| | | | |
|---|---|---|---|
| 2,664,734 | 1/1954 | McEneaney | 439/134 |
| 2,733,416 | 1/1956 | Evalt | 439/134 |
| 3,543,544 | 12/1970 | Efston | 439/134 |
| 4,025,140 | 5/1977 | Matys | 439/134 |
| 4,030,795 | 6/1977 | Niemann | 439/134 |

*Primary Examiner*—Paula A. Bradley

*Attorney, Agent, or Firm*—Biebel, French & Nauman

[57] ABSTRACT

A locking device for attachment to the male electric plug on the power supply line to an electric appliance, for the purpose of preventing use of the appliance, comprises a maximum of four separately molded plastic parts, two of which are identical and are secured together to form a housing containing one of the other two components, which is a unitary molded plastic spring locking member. The housing is provided with a pair of slots for receiving the prongs on the electric plug to be locked, and insertion of the prongs into the housing automatically effects the locking action. The device can be unlocked only by a key which is separate from the device, and which is the fourth component and is inserted through an opening into the interior of the housing to release the locking action.

9 Claims, 2 Drawing Sheets

ELECTRIC PLUG LOCK

CROSS-REFERENCE TO RELATED APPLICATION

This application is a continuation of co-pending application Ser. No. 390,046, filed Aug. 7, 1989 and now abandoned.

BACKGROUND OF THE INVENTION

This invention relates to a locking device for attachment to the male electric plug on the power supply line to an electric appliance for the purpose of preventing use of the appliance until the device has been removed.

Locking devices for this purpose have been available in the prior art for many years, and typical examples of the prior art approaches are found in the U.S. Pats. No. 2,654,073 of 1953 to Katz, McEneaney U.S. Pat. No. 2,664,734 of 1954, Evalt U.S. Pat. No. 2,733,716 of 1956, Sherman U.S. Pat. No. 4,167,658 of 1979 and Wiencke U.S. Pat. No. 4,445,738 of 1979 and Wiencke U.S. Pat. No. 4,445,738 of 1984. The characteristic common to the devices of all of these patents is their relative complexity, particularly including the number and variety of the parts which each of the complete devices is composed.

SUMMARY OF THE INVENTION

The primary object of the present invention is to provide a locking device for removable attachment to the male plug on the power line for an electrical appliance which is of extremely simple construction, involving a minimum of component parts, but which at the same time will be not only simply to apply and remove but highly reliable in resisting unauthorized removal.

This objective is achieved by the provision of a device which comprises a maximum of four separately molded parts, two of which are identical and are secured together to form a housing containing one of the other two components, which is a unitary spring locking member. The housing is provided with a pair of slots for receiving the prongs on the electric plug to be locked, and insertion of the prongs into the housing automatically effects the locking action. The fourth part is a key separate fromm the device which is inserted through another opening into the interior of the housing to release the locking action for removal of the device from the plug.

The manufacture of the device of the invention is very simple and economical, because each part can be molded of a suitable plastic material, and since two of the four parts are identical, a total of only three molds is needed for the manufacture of the devices. No other parts are required except conventional rivets for securing the two halves of the housing together.

The details of the component parts of the devices of the invention, and other objects and advantages of the invention, will be apparent from or pointed out in connection with the description of the preferred embodiment of the invention which follows.

DESCRIPTION OF THE PREFERRED EMBODIMENT

Figure 1:
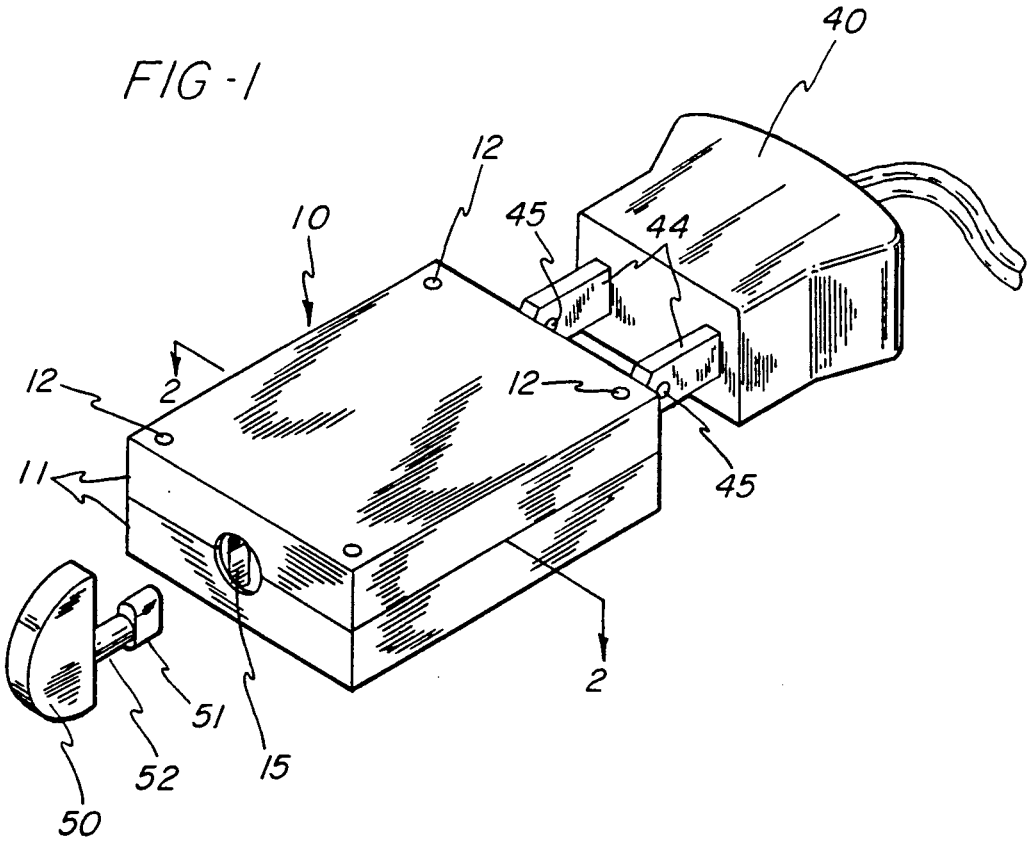
FIG. 1 is a view in perspective illustrating the use of a locking device in accordance with the invention with the prongs of a male electric plug positioned to be inserted into the lock.

The locking device of the invention includes a housing identified generally as 10 which is composed of two identical halves 11 of generally rectangular shape permanently secured together as by a rivet 12 at each of the four corners of the composite housing. Preferably, however, the two housing halves 11 will be solvent-welded or otherwise permanently secured together as a unitary structure to resist tampering. One end of the housing 10 is provided with a pair of slots 13 spaced to receive the prongs of a conventional male electrical plug, and at the other end of the housing is a hole 15 for the insertion of an unlocking key as described hereinafter.

Figure 2:
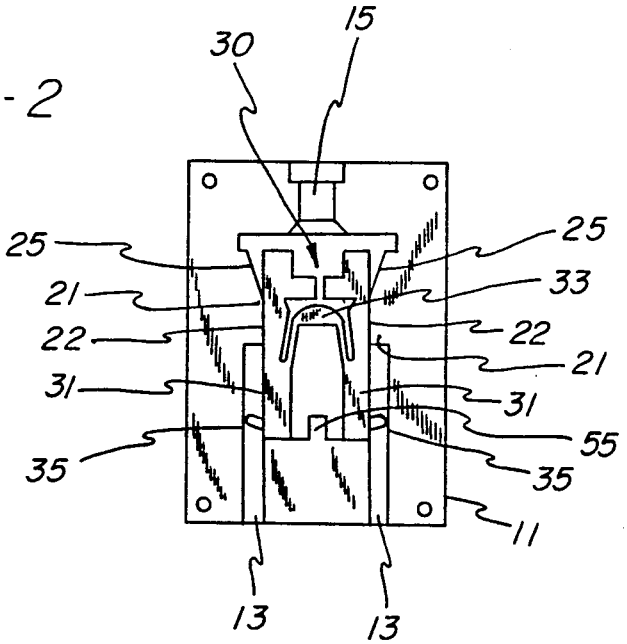
FIG. 2 is a view of the inside of one of the two identical parts of the housing with the internal spring member mounted therein, the view being on the line 2—2 in FIG. 1.
Figure 3:
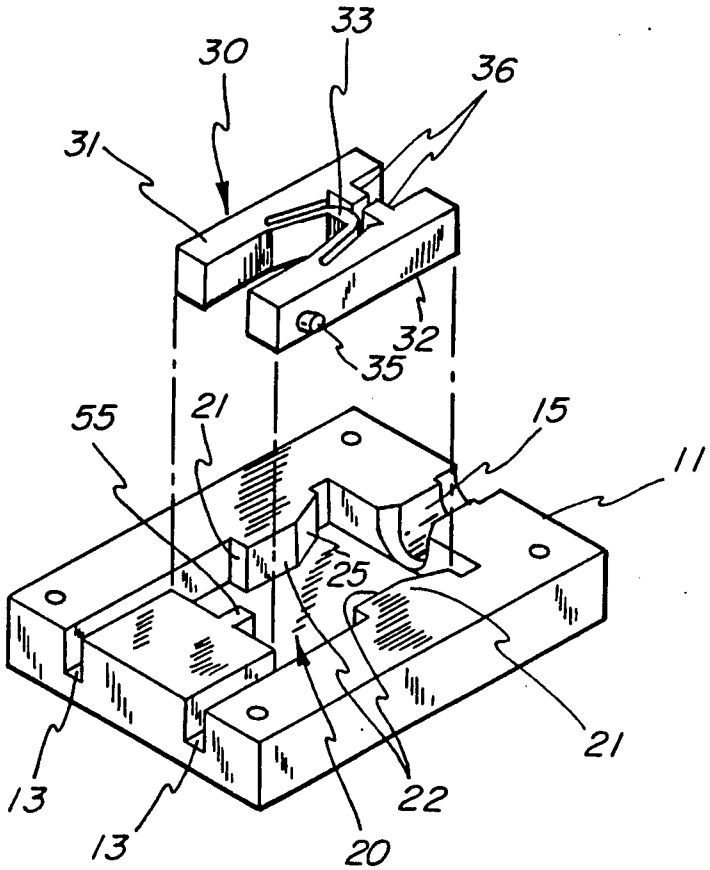
FIG. 3 is an exploded perspective view of the components of the device shown in FIG. 2.

The two housing parts 11 are formed on their respective interiors to define a main cavity 20 connecting at one end with the slots 13 and at the other end with the opening 15. As best seen in FIGS. 2 and 3, the cavity 20 is of approximately the same width at its two ends, but its opposed sides define a more constricted space and could be curved about a substantial radius. Preferably, however, each of these sides comprises a boss portion 21 extending inwardly of the cavity 20 and having a flat area 22 adjacent the ends of the slots 13, and a second flat area 25 inclined outwardly of the cavity 20 with respect to the area 22. Thus the opposed areas 22 are parallel with each other, while the opposed areas 25 are in diverging relation away from the areas 22. Also, each of the areas 22 should be coplanar with the inner side of the adjacent slot 13.

Within the cavity 20 is a unitary spring member 30 of generally W-shape in that it comprises a pair of straight outer arms 31 of sufficient cross section to be rigid, and a generally V-shaped or arched middle portion 33 connecting the arms 31. This middle portion 33 is of sufficient inherent resiliency to provide for movement of the arms 31 with respect to each other from the normal position shown in FIGS. 2 and 4 wherein the arms 31 are essentially parallel and have their outer sides supported by the flat surfaces 22 on the opposite sides of cavity 20.

Each of the arms 31 has a pin-like lateral projection 35 on its outer side at the end adjacent the slots 13, the purpose of this projection being to engage the aperture which is conventionally provided adjacent the end of each prong of an electric plug as described hereinafter. In addition, each arm 31 has a projection 36 on its inner surface at the opposite side of the arched portion 33 from the projection 35. These projections 36 act as stops limiting relative movement of the arms 31 in the corresponding direction.

FIG. 2 illustrates the normal positions of the respective portions of the spring member 30 when the device of the invention is ready for use by attachment to a male plug 40 shown in FIG. 1 as having a pair of prongs 44, each of which is provided with the usual aperture 45 adjacent its outer end. As shown in FIG. 2, the ends of the arms 31 adjacent the inner ends of the slots 13 lie just inside the slots, but the projections 35 thereon extend into the slots 13. However, each of these projections 35 is slanted inwardly of the device with respect to the arm 31 of which it forms a part and with respect to the length of the slot 13 into which it extends.

Figure 4:
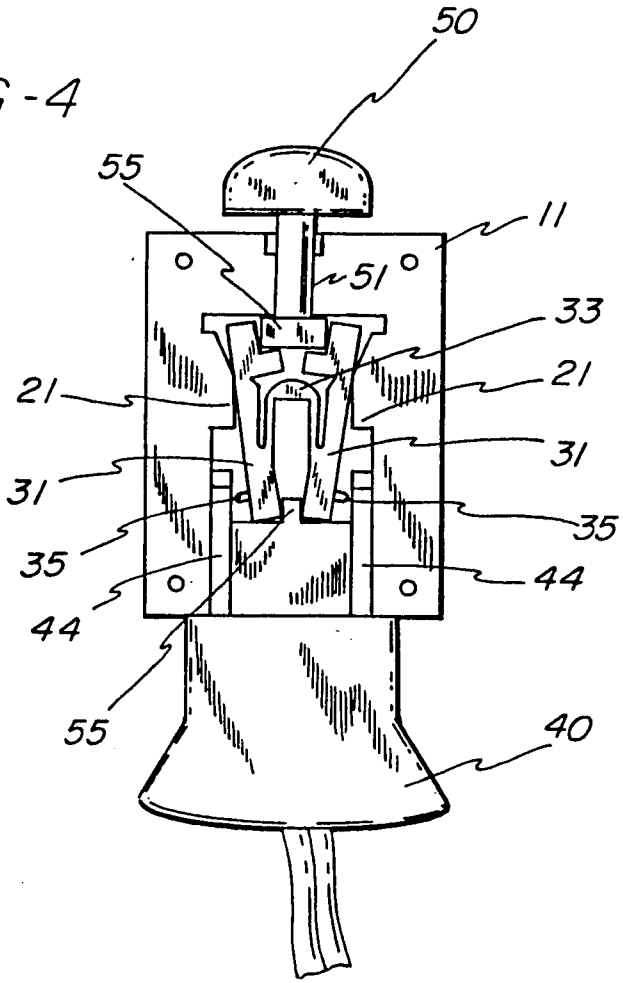
FIG. 4 is a view similar to FIG. 2, but with the prongs of a plug inserted, and showing the relationship of the parts when the spring member has been moved to its plug-releasing position.

With this structural arrangement, when the plug prongs 44 are inserted in the slots 13, the leading ends of the prongs will engage the slanted projections 35, and the resulting camming action will cause the arms to be forced toward each other as they are enclosed by the prongs 44 and caused to rock about the junction between the respective bearing surfaces 22 and 25 until the prongs move far enough for the projections 35 to enter the apertures 45. At that instant, the biasing action of the resilient middle portion 35 of the spring member 30 will cause the movements of the arms to be reversed, with the result that the projections 35 will enter apertures 45 and thereby lock the prongs against removal. This is therefore the locked position of the device as shown in FIG. 4.

The key 50 must be used to release the locking device from the plug 40, and as shown in FIG. 1, this key includes a paddle-like portion 51 of greater width than thickness, and a cylindrical stem portion 52. Preferably the hole 15 in the end of the housing is similarly shaped to receive this paddle portion 51, with the longer dimension of the hole running at right angles to the width of the housing 10.

Accordingly, after the key 50 is inserted in the housing, it will extend into the space between the adjacent ends of the arms 31 outwardly of the stops 36, and when it is then turned approximately 90°, those ends of the arms will be forced to move apart, rocking the arms again about the junctions between the bearing surfaces 22 and 25 until the projections 35 are withdrawn from the apertures 45. This is the release position of the locking device, and it can be withdrawn from the prongs 44 and thereby release the plug 40 for insertion in an electric outlet and the use of the device to which it provides operating power. In order to assure uniform movement of both of the spring arms 31, the housing halves may each be provided with a boss 55 centered between the slots 13 to limit movement of the adjacent ends of arms 31 toward each other as shown in FIG. 4.

As will now be apparent from the drawings as described above, the individual parts of each locking device in accordance with the invention are of simple construction making it particularly suitable for quantity production by conventional plastic molding techniques. It is necessary merely to select a material of adequate inherent resiliency in parts of the desired dimensions, typical such satisfactory materials including nylon, delrin and polypropylene, any of which may incorporate glass fiber for extra strength.

The dimensions of the parts are not critical so long as they are of sufficient size to withstand the comparatively low extent of relative movement required of the spring member 30, and as a reference in this connection, satisfactory results have been obtained with each of the housing halves 11 approximately 1.25×1.5 inches, and with the cavity 20 therein and the spring member 30 proportionally dimensioned. The shape of the outside of the composite housing 10 is also subject to substantial variation, as by providing it with rounded corners at the end containing the hole 15, thereby providing some reduction in the amount of material needed to produce each device. Assembly of each complete device is also quick and easy, since after any flash is removed from the plastic parts, all that is necessary is to set a spring member 30 in a half housing 11, set the other half housing 11 in place, and then complete the assembly by securing the two housing halves together.

While the article herein described constitutes a preferred embodiment of the invention, it is to be understood that the invention is not limited to this precise article and that changes may be made therein without departing from the scope of the invention which is defined in the appended claims.

What is claimed is:

1. A locking device for preventing use of an electric appliance plug having two prongs, each of which prongs has an aperture therethrough adjacnet the outer end thereof, comprising:

(a) a housing having therein a main cavity and also a pair of spaced slaots in one end thereof for receiving the plug prongs and extending into said cavity, (b) a unitary spring member of generally W-shape within said cavity, (c) said spring member including a pair of arms on opposite sides thereof integrally connected by a generally arched resilient middle portion biasing said arms to normal positions wherein the ends of said arms adjacent said slots lie in the space between said slots, (d) the opposed sides of said cavity including boss portions extending inwardly of said cavity and defining bearing surfaces engaging and supporting the outer sides of said spring member arms for rocking movement thereon with respect to each other, (e) each of said arms having on the outer side thereof a lateral projection positioned to be received in said aperture in one of said prongs, (f) whereby upon insertion of said prongs in said slots, said prongs will enclose and compress the adjacent ends of said arms will said prong apertures are aligned with said projections and said spring member will cause said arms to move in the opposite direction to engage said projections in said apertures, (g) said cavity having an access hole in the opposite end thereof from said slots, and (h) means insertable through said access holes for effecting rocking movement of said arms in the directions to release said projections from said prongs for separation of said plug from said locking device.

2. A locking device as defined in claim 1 wherein said housing comprises a pair of identical half sections, and means permanently securing said half sections together with said spring member enclosed therebetween.

3. A locking device as defined in claim 1 further comprising stop means in said cavity and adjacent said slots for limiting said rocking movement of each of said arms toward the other of said arms.

4. A locking device as defined in claim 1 wherein said projections are proportioned to extend into said slots in said normal positions of said arms for engagement by the ends of said prongs inserted in said slots to cam the adjacent ends of said arms toward each other.

5. A locking device as defined in claim 4 wherein said projections are inclined inwardly of the length of said slots to facilitate the camming interaction thereof with the ends of prongs inserted in said slots.

6. A locking device as defined in claim 1 wherein said outer sides of said arms are flat, and each of said boss portions on said opposed sides of said cavity comprises a pair of contiguous flat surfaces, one of said surfaces being closer to said slots and being substantially parallel with said slots, and the other of said surfaces being inclined in diverging relation with the corresponding surface on the opposed said side of said cavity, whereby each said pair of surfaces defines a junction line about which said arms are caused to rock.

7. A locking device as defined in claim 6 wherein said first of each of said opposed surfaces is in substantially coplanar relation with the inner surface of the adjacent said slot to maintain the adjacent said arm in the space between said slots.

8. A locking device as defined in claim 1 wherein said spring member is a unitary part of molded material having adequate inherent resiliency.

9. A locking device as defined in claim 8 wherein said spring member further comprises stop means on the opposed surfaces of the ends of said arms remote from said slots for limiting relative movement of said arms in one direction from said normal positions thereof.

* * * * *